United States Patent [19]

Hörmann et al.

[11] Patent Number: 4,844,746

[45] Date of Patent: Jul. 4, 1989

[54] METHOD OF PRODUCING A TANTALUM STOCK MATERIAL OF HIGH DUCTILITY

[75] Inventors: Michael Hörmann, Mömbris; Otto Bach, Schöneck, both of Fed. Rep. of Germany

[73] Assignee: W. C. Heraeus GmbH, Hanau, Fed. Rep. of Germany

[21] Appl. No.: 172,201

[22] Filed: Mar. 23, 1988

[30] Foreign Application Priority Data

Apr. 10, 1987 [DE] Fed. Rep. of Germany ..... 3712281

[51] Int. Cl.[4] ..... C21D 1/00

[52] U.S. Cl. ..... 148/2; 75/84; 148/11.5 F; 148/133; 420/427

[58] Field of Search ..... 148/11.5 F, 133, 2; 75/84; 420/427

[56] References Cited

U.S. PATENT DOCUMENTS 2,825,641 3/1958 Beall et al. ..... 75/10.12
3,285,716 11/1966 Contant ..... 420/427
4,722,756 2/1988 Hard ..... 148/133

OTHER PUBLICATIONS

Mordike, B. L. , Z. Metallkde 55 (1964) 304.
Zedler et al., Z. Metallkde, 56 (1965) 316.
Dinter, R. J., Z. Metallkde, 58 (1967) 70.
Reed et al., Rept. Ornl-4952, May 1974, p. 129.

*Primary Examiner*—Upendra Roy
*Attorney, Agent, or Firm*—Felfe & Lynch

[57] ABSTRACT

A method is described for the production of a ductile tantalum stock material for high-speed deformation use. A bar-shaped body is made from directly reduced tantalum powder of a given purity and is remelted repeatedly as a consumable electrode in an electron beam furnace. The obtained ingot is shaped into a slab which, after being machined to a smooth surface, is further worked to produce the stock material. At least one heat treatment under vacuum is included in the process of making the stock material.

7 Claims, No Drawings

METHOD OF PRODUCING A TANTALUM STOCK MATERIAL OF HIGH DUCTILITY

FIELD OF THE INVENTION

The invention relates to a method for the production of a tantalum stock material of high ductility for use in the field of high-speed deformation.

BACKGROUND OF THE INVENTION

In the field of high-speed deformation such as, for example, in the case of projectiles, high-ductility iron or copper is usually used. The depth of penetration of the projectile is a function both of the density of the high-ductility material and of the density of the material on which the projectile impacts. Efforts have long been made to produce a highly ductile material of very high density.

SUMMARY OF THE INVENTION

The object of the inventive method is the production of a tantalum stock material of high ductility which will be suitable for use in the field of high-speed deformation, especially for projectiles.

This object is achieved by producing a bar which is pressed from directly reduced tantalum powder containing less than 100 micrograms of niobium, tungsten and possibly molybdenum per gram of powder. The bar is melted down as a consumable electrode in an electron beam furnace which has a pressure maintained at less than $5\times10^{-4}$, mbar, the molten metal is collected in a cooled mold, and an ingot is formed. The ingot is remelted at least twice in the electron beam furnace while maintaining a pressure of less than $5\times10^{-4}$ mbar and the ingot obtained in the final remelting cycle is shaped into a slab.

The slab is machined to a smooth surface on all sides to a maximum depth of roughness of 25 microns. From the smoothed slab, stock materials are made by a conventional shaping process and in this manufacturing process at least one heat treatment is included in either an inductively heated or a resistance heated furnace while maintaining a pressure of less than $5\times10^{-4}$ mbar. Both furnaces may be used together for the heating treatment.

DETAILED DESCRIPTION OF THE PREFERRED EMBODIMENT

Sodium-reduced tantalum powder is preferably used in the inventive method. The ingot which is obtained by melting down the pressed tantalum powdered body is preferably melted in the electron beam furnace at a higher melting rate (kg/h) than the pressed body. It is preferable to make the melting rate of the ingot at least twice as great as the melting rate of the pressed body.

In making the slab, the ingot obtained from the final remelting cycle is first cold-forged to stock which is divided into individual blocks. Then each individual block is heated in a slightly oxidizing atmosphere to a temperature of about 650° C. and after it is removed from the furnace, when the piece is still at a temperature in the range of from 450 to 600° C., it is upset. After cooling completely to room temperature the upset piece is cold-forged to a slab.

In the process of producing the stock material it is preferable to include a cold rolling step with shaping degrees of $\rho\geqq1.2$ ($\epsilon$70%), which includes not only rolling in the direction of the axis of the ingot last obtained but also rolling in a transverse direction. It is preferable to perform a tension-relieving annealing before the cold rolling step at a temperature of about 650° C. and after the cold rolling step to perform a recrystallization heat treatment in the range of about 900° C.

As the product of the process according to the invention, highly ductile tantalum stock materials are obtained which are isotropic in regard to their mechanical properties and their structure. The tantalum stock materials prepared according to the invention are texture-free and have a grain size that is finer than 30 microns (according to ASTM E 112). Their tensile strength is less than 200 N/mm$^2$, their elongation is greater than 60%. The overall purity of the materials according to the invention is computed by determining the residual resistance ratio (electrical resistance at a temperature of 273 K: electrical resistance at the temperature of 4.2 K). Materials obtained by the inventive method have a residual electrical resistance ratio of at least 200.

EXAMPLE

A method for preparing a highly ductile tantalum stock material will be described with the aid of the following example.

To produce the pressed bar, sodium-reduced tantalum powder was used whose content of impurities (micrograms per gram) is to be seen in the following table:

| Elements: | Nb | Fe | Ti | W | Mo | Si | Ni | Mn |
|---|---|---|---|---|---|---|---|---|
| mcgm/g | 40 | 130 | <10 | <50 | <20 | 30 | 50 | <10 |
| | C | O | H | N | | | | |
| | 55 | 3300 | 15 | 55 | | | | |

From this tantalum powder a bar was prepared by cold isostatic pressing. This bar was used as a consumable electrode in an electron beam furnace and melted at a rate in the range of 25 to 35 Kg/h. During the melting process a pressure of $2\times20^{-4}$ mbar was maintained. The melt was gathered in a water-cooled mold and an ingot was formed having a diameter of 150 mm. This ingot was then twice remelted in the electron beam furnace, the ingot produced being used again as the consumable electrode.

During the first remelting a pressure of $8\times10^{-5}$ mbar was maintained in the electron beam furnace, and the melting rate was in the range of 70 to 100 Kg/h. The corresponding figures for the second remelting were $6\times10^{-5}$ mbar, and the melting rate was again in the range of 70 to 100 Kg/h, while in the final remelting the pressure in the electron beam furnace had been lowered to $3\times10^{-5}$ mbar and the melting rate was 120 Kg/h. The diameter of the ingot obtained in the final remelting cycle was 175 mm.

The ingot finally obtained was then shaped by thermomechanical methods to a slab. First the ingot was cold formed to a 150 mm octagon shape, and then it was divided into single blocks of 350 mm length. Each piece was then heated in a gas-fired hearth furnace in a slightly oxidizing atmosphere at 650° C. and held at this temperature for a period of about 1 to 3 hours. After removal from the hearth furnace the individual pieces were upset on a forging hammer at a temperature of about 550° C. After it had completely cooled to room temperature the upset individual piece was cold-formed to a slab, down to a size of about $160\times65\times800$ mm. This was followed by a milling process to a rough depth of 20 microns to smooth the slab. The smoothed slab was degreased and pickled first in aqua regia and then in an acid mixture consisting of two parts by volume of concentrated nitric acid and two parts by volume of water. This was followed by a cold rolling at a high rate of thickness reduction per pass, the rolling being performed both in the direction of the axis of the last-obtained ingot and in the direction across it. The deformation amounted to $\rho \geqq 1.3$ ($\epsilon \geqq 75\%$). After this cold rolling process the cold-rolled piece was degreased and pickled. Then an annealing to reduce tensions was performed in an inductively heated oven in which a pressure of $2 \times 10^{-4}$ mbar was maintained during the treatment. After this annealing the annealed piece was subjected to several cold rollings, the rolling being performed again in directions across and parallel to the axis of the last-obtained ingot. This cold rolling was also performed at a high rate of thickness reduction. The degree of deformation was $\rho \geqq 1.9$ ($\epsilon \geqq 85\%$). After this cold rolling the workpiece was, as already described above, ground, degreased and pickled and then subjected to a recrystallization treatment at 875° C. in a resistance-heated vacuum furnace.

The highly ductile tantalum product thus obtained was texture-free and had a grain size finer than 30 microns according to ASTM E 112). Its tensile strength was 192 N/mm$^2$, its elongation 65%, and the residual resistance ratio was found to be 220.

I claim:

1. A method for producing a ductile tantalum stock material used in high-speed deformation applications comprising:

(a) preparing a bar-shaped body by pressing a directly reduced tantalum powder having less than 100 micrograms per gram of said powder containing at least one member of a group consisting of niobium, tungsten, molybdenum and a mixture thereof;

(b) melting said body in an electron beam furnace having a pressure maintained at less than $5 \times 10^{-4}$ mbar to form a melt;

(c) collecting said melt in a cooled mold to form an ingot;

(d) remelting said ingot as a consumable electrode at least twice in the electron bean furnace having a pressure maintianed at less than $5 \times 10^{-4}$ mbar to form a remelted ingot;

(e) forming said remelted ingot into a slab;

(f) machining said slab on its sides until a smooth texture having a roughness depth of at most 25 microns is achieved; and (g) shaping said slab, and heat treating said slab at least once in a vacuum furnace, while maintaining a pressure of less than $5 \times 10^{-4}$ mbar, to form a semi-manufacture.

2. The method according to claim 1, wherein said remelting step comprises remelting said ingot at a melting rate which is higher than a melting rate used to melt the body.

3. The method according to claim 1 wherein said forming step comprises: shaping said remelted ingot by cold forming to form a piece which is divided into individual block-like pieces, heating each of said individual pieces in an oxidizing atmosphere to a temperature of about 650° C.; cooling said pieces to a temperature in the range of 450° C. to 600° C.; upsetting the pieces on a forging means; subsequently cooling the pieces to a room temperature; and cold-forging said pieces to form said slab.

4. The method according to claim 1 wherein said shaping step comprises cold-rolling said slab in a direction parallel to an axis of said remelted ingot and in a direction transverse to said axis to achieve a deformation value of 1.2 and 70%, and then heat treating said slab at least once to form said semi-manufacture.

5. The method according to claim 2, wherein said remelting step further comprises: remelting said ingot at a melting rate being at least twice as great as the melting rate of the body.

6. The method according to claim 4 wherein said cold rolling step comprises: annealing said slab at a temperature of about 650° C. before the cold rolling step is performed; and recrystalizing said slab by means of a heat treatment performed in the range of about 800 to 900° C. after said cold rolling step is performed.

7. A ductile tantalum stock material suitable for high-speed deformation, said material comprising:

a directly reduced tantalum powder, and an additive powder containing at least one member of a group consisting of niobium, tungsten, molybdenum and a mixture thereof, said additive powder being mixed with said tantalum powder in an amount of less than 100 micrograms of said additive per gram of said mixture, said powder mixture having been pressed to form a bar-shaped body, melted in an electron beam furnace having a pressure maintained at less than $5 \times 10^{-4}$ mbar to form an ingot, and remelted at least twice as a consumable electrode in the electron beam furnace to form a slab, said slab being smoothly machined to a roughness depth of at most 25 microns, shaped into a semi-manufacture, and heat treated at least once in a vacuum furnace, while maintaining a pressure of less than $5 \times 10^{-4}$ mbar.

* * * * *

UNITED STATES PATENT AND TRADEMARK OFFICE

CERTIFICATE OF CORRECTION

PATENT NO. : 4,844,746

DATED : July 4, 1989

INVENTOR(S) : Michael Hormann, et al.

It is certified that error appears in the above-identified patent and that said Letters Patent is hereby corrected as shown below:

Column 1, line 67, "($\epsilon$ 70%)" should be -- ($\epsilon \geq$ 70%)--.

Signed and Sealed this

Twenty-first Day of August, 1990

*Attest:*

HARRY F. MANBECK, JR.

*Attesting Officer*

*Commissioner of Patents and Trademarks*